US005305980A

United States Patent [19]

Le Blanc

[11] Patent Number: 5,305,980

[45] Date of Patent: Apr. 26, 1994

[54] REMOTE CONTROL UNIT HOLDER

[76] Inventor: James F. Le Blanc, 27 Heath Rd., Fishkill, N.Y. 12524

[21] Appl. No.: 93,468

[22] Filed: Jul. 19, 1993

[51] Int. Cl.[5] ..... A47F 7/00

[52] U.S. Cl. ..... 248/309.1; 248/172; 211/13

[58] Field of Search ..... 248/309.1, 172, 316.1, 248/310, 346, 670, 908; 211/13, 26, 175; 273/148 B

[56] References Cited

U.S. PATENT DOCUMENTS

| | | | |
|---|---|---|---|
| Re. 33,970 | 6/1992 | Butler | 248/309.1 X |
| 3,895,768 | 7/1975 | Scheck | 248/310 X |
| 4,458,874 | 7/1984 | Rabas et al. | 248/670 |
| 4,739,887 | 4/1988 | Beach | 211/13 |
| 4,848,609 | 7/1989 | Meghnot | 248/309.1 X |
| 4,856,658 | 8/1989 | Novak | 211/13 |
| 4,893,222 | 1/1990 | Mintzer | 248/172 X |
| 5,127,615 | 7/1992 | Jones | 248/172 |

*Primary Examiner*—Karen J. Chotkowski
*Attorney, Agent, or Firm*—Edward R. Hyde

[57] ABSTRACT

A holder for a remote control device for controlling electronic equipment as television and video cassette recorders. The holder protects the device while permitting ready access to the control buttons. Full adjustability is provided to enable the holder to accommodate devices of different widths, lengths and thicknesses.

10 Claims, 2 Drawing Sheets

REMOTE CONTROL UNIT HOLDER

BACKGROUND OF THE INVENTION

1. Field of the Invention

The present invention relates to a hand held holder for remote control devices of the type used for controlling televisions, stereos, video cassette recorders and other similar type units.

It is customary for modern television receivers and similar electronic devices to be remotely controlled by the usually generally rectangular shaped remote control unit. As is well known, the unit includes a number of buttons by which the operator can control the selection, volume and other variables of the electronic device being operated. It is not unusual for the household to have a number of communication units being controlled and correspondingly a number of hand held control units.

These units are generally located around the home in whatever location they may be left after the prior use and finding a particular control device for a particular electronic communications system sometimes takes a certain amount of time. Also, the units are generally encased in a plastic container that is susceptible to being broken as by being stepped upon or other rough use that may result from inadvertence or children playing with the unit.

Accordingly, it is desirable to have a holder for the remote control unit somewhat substantially larger than the unit so that it may be easily located and of sturdy and strong construction to prevent damage to the unit. The present invention is directed to such a holder for a remote control device.

2. Description of the Prior Art

Representative of prior art patents is U.S. Pat. No. 4,848,609 that discloses an adjustable holder for a plurality of remote control devices. The holder is adjustable in that it can receive remote control units of various widths. U.S. Pat. No. 4,824,059 teaches and discloses a flexible remote control holder designed to protect the unit from impacts, shocks, etc. Another patented device is shown in U.S. Pat. No. 4,836,256 which contemplates a remote control unit sheath into which the unit may be slid for protection.

None of these units of the prior art disclose a holder that will receive remote control units of various sizes and protect the unit from loss or impact damage as the present invention. The device hereinafter described is a structure that will conveniently receive a remote control unit of any of the conventional sizes and firmly hold it in position in a safe, protected manner. Further, it makes it more difficult to lose and easier to locate.

SUMMARY OF THE INVENTION

Against the foregoing background, it is a primary object of the present invention to provide a hand held holder for a remote control device which will securely maintain the device in a firm and fixed manner.

It is a further object of the present invention to provide a hand held holder for a remote control device which has conveniently adjustable elements that facilitate the reception of units of various sizes.

It is a still further object of the present invention to provide an adjustable remote control holder that is readily and conveniently adjusted by the operator to receive remote control units of various sizes.

Accordingly, the present invention contemplates a holder comprising a hollow body member having internal slots to receive elements of the holder. The plurality of slots permit the elements of the unit to be located at various distances to receive remote control units of different thicknesses. Other elements of the holder that are received within the body member may be adjusted to receive control units of different lengths and widths with the result that the holder of the present invention is well adapted to receive remote control units of various sizes. The holder is of sturdy construction to protect from damaging the control unit in which it is located.

BRIEF DESCRIPTION OF THE DRAWINGS

The foregoing and still other objects and advantages of the present invention will be more apparent from the following detailed explanation of the preferred embodiment of the invention considered in connection with the accompanying drawings herein in which.

DESCRIPTION OF THE PREFERRED EMBODIMENT

Figure 1:
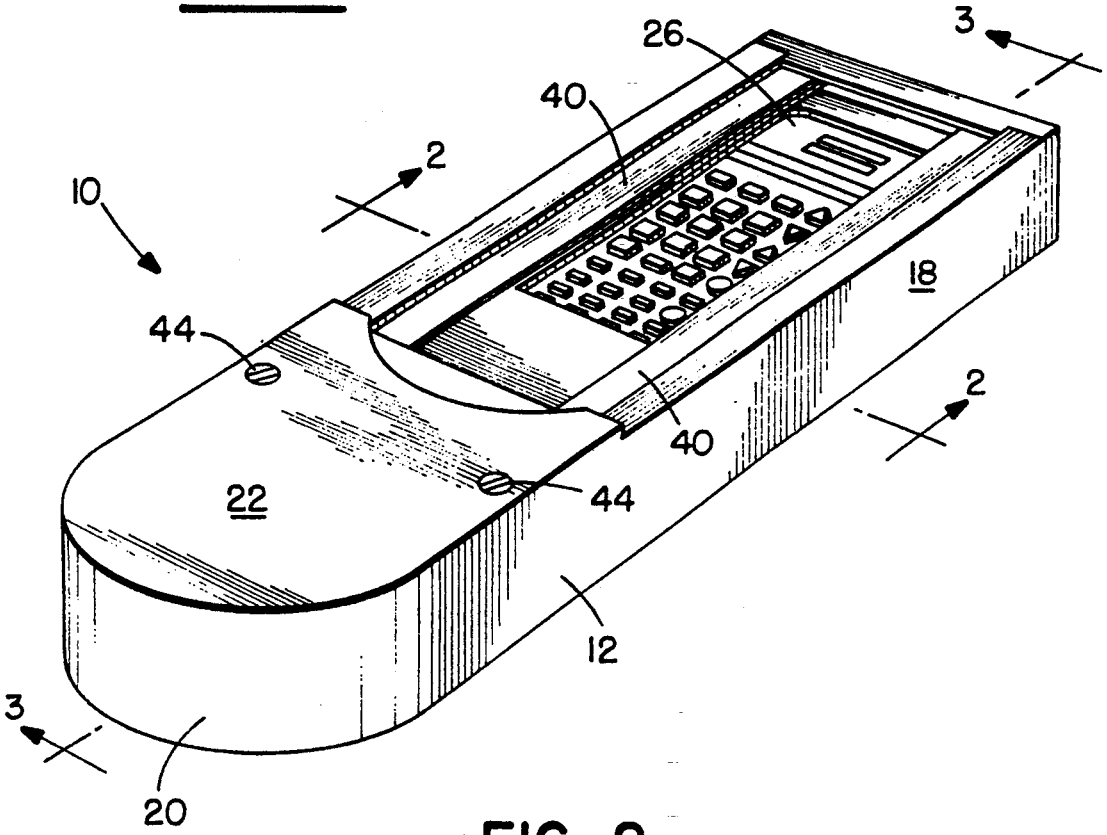
FIG. 1 is a perspective view of the holder with a remote control device in place within it.
Figure 2:
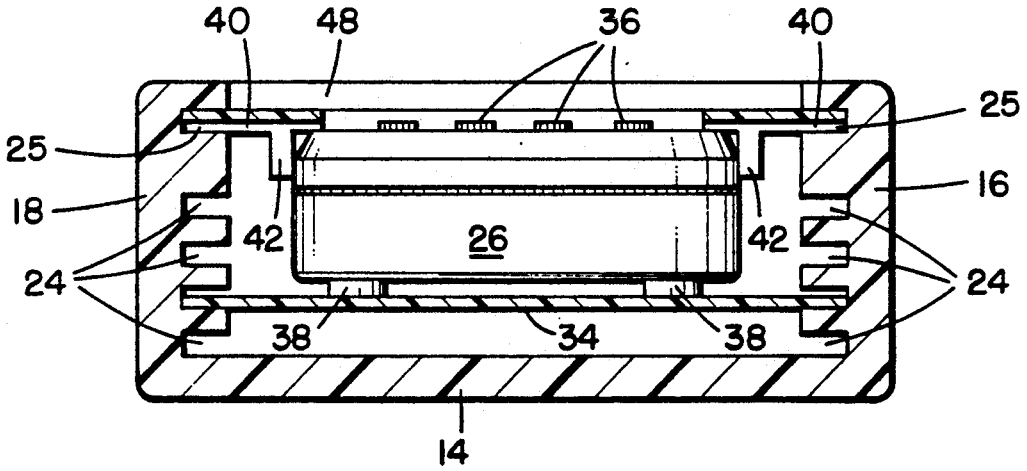
FIG. 2 is a sectional view taken on the line 2—2 of FIG. 1.
Figure 3:
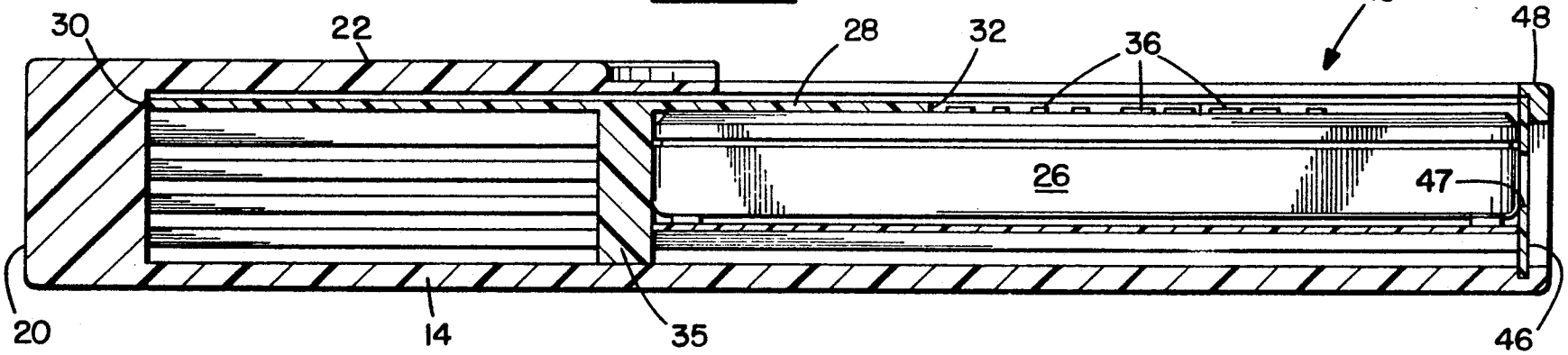
FIG. 3 is a sectional view taken on the line 3—3 of FIG. 1.

Referring now to the drawings and more particularly to FIGS. 1, 2 and 3, numeral 10 indicates the remote control holder of the present invention which includes a body member 12 that may for example be made of molded plastic. The body member includes a bottom 14, sides 16, 18, a rounded back end 20 and a top 22 extending somewhat less than half the length of the body member. The front end is open to receive the remote control device and other elements of the holder hereinafter described. The inner surfaces of body sides 16, 18 are slotted as more clearly seen in FIG. 2 wherein each side member contains four lower slots 24 and an upper slot 25.

It is seen that the remote control device 26 fits snugly within the holder. A top plate 28 is received in the upper slots 25 of the side members and the rear end of the top plate abuts against the back of the body member as shown at 30 in FIG. 3. The forward end 32 of the top plate extends to a point just before the control buttons of the remote control member 26. The underside of top plate 28 has a stop 35 that extends downwardly when the top plate is in position within its slots as shown in FIG. 3. The stop 35 serves to locate the rear end of device 26 such that the front end of the remote control terminates at the front end of the holder.

It is understood that different remote control devices are of different thicknesses and it is for this reason that the multiple slots 24 are provided. Thus a bottom plate 34 is received in a pair of slots 24 in order to support the device 26 in a position such that the control buttons 36 are located toward the top surface of the holder. In the embodiment shown the bottom plate 34 is received in the second pair of slots 24 up from the bottom 14. In the event that a thicker remote control device 26 were to be received in the holder, the plate 24 would be located in the bottom pair of slots. It is seen that the remote control device 26 has the usual scratch pads 38 that rest upon the bottom plate. In some instances it may be necessary to insert shims (not shown) between the bottom plate 34 and the pads 38.

In order to retain the remote control device 26 and prevent sidewise movement, a pair of rails 40 are provided which are received in the upper pair of side slots 25. Each rail 40 has a depending portion 42 that abut against the sides of the remote control device. It is seen that the thickness of the upper plate 28 and each rail 40 is such that they are both received within their respective slots 25 as more clearly seen in FIG. 2.

With the above described members in place holding the remote control device in position, screws 44 are inserted passing through body top 22, each of the side rails 40, and top plate 28 to retain these members in place. End member 46 is then inserted in slots in the forward ends of body sides 16, 18 and bottom 14. A molding member 48 is then secured to the body sides to complete the structure. The end 46 and molding 48 are easily removable to permit the control unit to be removed from the holder for battery replacement or other reason.

The forward end of the remote control device has the cutomary radiation window to emit radiation to control the electronic device. Accordingly, the end 46 has a transparent window 47, as shown in FIG. 3, to permit the radiation from the device to pass to the controlled electronic device.

As pointed out above and as is well understood, remote control devices come in different sizes and in particular may vary in length width and thickness. The present invention will accommodate a large variety of device sizes by a novel means of adjustability. In particular, the top plate, bottom plate and side rails are constructed so that the user or operator may adjust them to the proper size of a particular remote control device. These members may be conveniently made of a sheet plastic material and each may be trimmed or cut to the appropriate size using ordinary household scissors.

Figure 4:
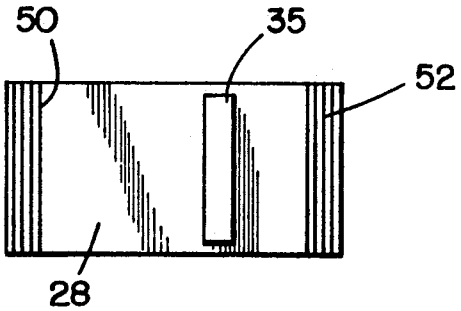
FIG. 4 is a plan view of the underside of the top plate showing scored lines for adjustment.

Referring to FIG. 4, there is shown the underside of top plate 28 and it is seen that each end of the plate has a plurality of scored lines such as 50, 52. Thus the user may conveniently trim the length of the top plate to fit the length of the control device. In particular, the end at the scored lines 50 will be cut to position the stop 35 at a point such that the length of the remote control device 26 will extend from the forward surface of the stop to the front end 46 of the holder. Similarly, the end of the top plate at scored lines 52 will be trimmed so that the entire set of control buttons 36 will be exposed.

Figure 6:
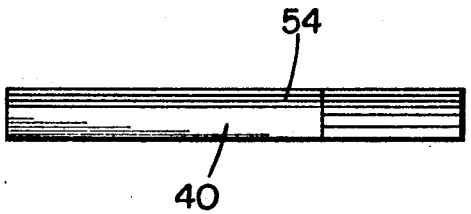
FIG. 6 is a plan view of a side rail.
Figure 5:
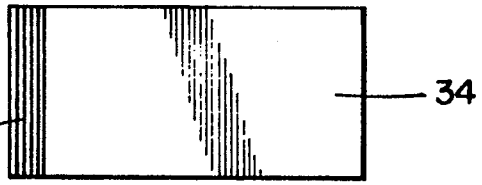
FIG. 5 is a plan view of the bottom plate.

FIG. 5 shows the scored lines 53 at one end of bottom plate 34. Thus the end of this plate may be trimmed to adjust to the length of the remote control device. Similarly, FIG. 6 shows side rails 40 contain elongated score lines 54 to permit width adjustment of the side rails to accommodate the width of the particular remote control device being used.

From the above description it is seen that the present invention contemplates an efficient, rugged remote control device holder of simple construction. It is adjustable to take devices of different lengths, widths and thicknesses and firmly hold them in place.

Having thus described the invention with particular reference to the preferred forms thereof, it will be obvious that various changes and modifications may be made therein without departing from the spirit and scope of the invention as defined in the appended claims.

What is claimed is:

1. An adjustable device for holding a remote control device of the type having control buttons on the top thereof and a radiation transmission window at one end comprising:

an elongated hollow body member adapted to receive a remote control device;

top means secured in the body member adapted to partially cover the top of a remote control device and leave the top buttons thereof uncovered whereby they can be operated with the control device in place within said adjustable device;

bottom means secured in the body member a distance from the top means corresponding to the thickness of a remote control device;

two side means secured in the body member separated a distance corresponding to the width of a remote control device;

adjustable means to adjust the distance between the top means and the bottom means; and said top means including stop means adapted to abut against one end of a control device located within the body member.

2. The device set forth in claim 1 in which the adjustable means comprises means providing a plurality of pairs of slots.

3. The device set forth in claim 2 including an end member closing one end of the body member and having a window located adjacent the radiation transmission window of a remote control device located within the body member.

4. A device as set forth in claim 3 in which said two side means are received in a pair of said plurality of pairs of slots and each side member has a depending projection to engage a side of a remote control device positioned within the body member.

5. The device as set forth in claim 1 in which said top means includes means to adjust the length thereof.

6. The device as set forth in claim 1 in which said bottom means includes means to adjust the length thereof.

7. The device set forth in claim 1 in which each of the two side means includes means to adjust the width thereof.

8. An adjustable device for holding a remote control unit comprising:

an elongated hollow body member having a bottom, two side members and a closed end;

means providing a plurality of matching elongated slots extending along an inner surface of the said two side members;

a top plate received in a first pair of said matching slots and partially covering the top of the body member;

a bottom plate received in a second pair of said matching slots;

said top plate and said bottom plate being separated a predetermined distance corresponding to the thickness of a remote control unit;

a pair of side rails each received in a corresponding one of said first pair of matching slots;

each of said side rails having a depending strip;

said strips being separated a predetermined distance corresponding to the width of a remote control unit;

said top plate having a depending stop member;

the distance from the stop member to the front end of the body member being a predetermined distance corresponding to the length of a remote control unit;

a front end member secured to the front of the body member; and said front member having an opening positioned to correspond to the window of a control unit located within the body member.

9. The device set forth in claim 8 in which each of said top plate and said bottom plate includes means to adjust the length thereof.

10. The device set forth in claim 9 in which each said rail includes adjustable means to adjust the width thereof.

* * * * *